US006799956B1

(12) United States Patent
Yap et al.

(10) Patent No.: US 6,799,956 B1
(45) Date of Patent: Oct. 5, 2004

(54) ROTARY COMPRESSOR HAVING TWO-PIECE SEPARATOR PLATE

(75) Inventors: Zer Kai Yap, Tecumseh, MI (US); David Lee Black, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/414,331

(22) Filed: Apr. 15, 2003

(51) Int. Cl.[7] ..... F03C 2/00

(52) U.S. Cl. ..... 418/60; 418/63; 418/200; 29/888.025

(58) Field of Search ..... 418/60, 63, 200; 29/888.025; 417/423.14, 423.12

(56) References Cited

U.S. PATENT DOCUMENTS

| | | | |
|---|---|---|---|
| 4,547,131 | A | 10/1985 | Riffe et al. |
| 4,605,362 | A | 8/1986 | Sturgeon et al. |
| 4,623,304 | A | 11/1986 | Chikada et al. |
| 4,726,739 | A | 2/1988 | Saitou et al. |
| 4,815,947 | A | 3/1989 | Okoma et al. |
| 4,826,408 | A | 5/1989 | Inoue et al. |
| 4,958,990 | A | 9/1990 | Gordon et al. |
| 5,152,156 | A | 10/1992 | Tokairin |
| 5,242,280 | A | 9/1993 | Fujio |
| 5,322,424 | A | 6/1994 | Fujio |
| 5,326,233 | A | 7/1994 | Mochizuki et al. |
| 5,518,381 | A | 5/1996 | Matsunaga et al. |
| 5,542,831 | A | 8/1996 | Scarfone |
| 5,678,299 | A | 10/1997 | Mochizuki et al. |
| 5,782,618 | A | 7/1998 | Nishikawa et al. |
| 5,782,622 | A | 7/1998 | Ozu et al. |
| 6,193,485 | B1 | 2/2001 | Ueda et al. |
| 6,280,168 | B1 | 8/2001 | Matsumoto et al. |
| 6,318,981 | B1 | 11/2001 | Ebara et al. |
| 6,336,799 | B1 | 1/2002 | Matsumoto et al. |
| 6,413,061 | B1 | 7/2002 | Esumi et al. |
| 6,427,479 | B1 | 8/2002 | Komatsubara et al. |
| 6,447,274 | B1 | 9/2002 | Horihata et al. |
| 2002/0006344 | A1 | 1/2002 | Matsumoto et al. |
| 2002/0051715 | A1 | 5/2002 | Matsumoto et al. |

FOREIGN PATENT DOCUMENTS

| | | | | |
|---|---|---|---|---|
| JP | 57179397 A | * | 11/1982 | ..... F04C/23/00 |
| JP | 59136595 A | * | 8/1984 | ..... F04C/23/00 |
| JP | 63205486 A | * | 8/1988 | ..... F04C/23/00 |
| JP | 02123294 A | * | 5/1990 | ..... F04C/23/00 |

* cited by examiner

*Primary Examiner*—Thomas Denion
*Assistant Examiner*—Theresa Trieu
(74) *Attorney, Agent, or Firm*—Baker & Daniels

(57) ABSTRACT

A twin cylinder rotary compressor including first and second cylinders; a crankshaft having first and second eccentrics mounted thereon, the first eccentric disposed within the first cylinder, the second eccentric disposed within the second cylinder; and a separator plate disposed between the first and second cylinders and having a first piece and a complementary second piece. Each of the first and second pieces includes an interior surface defining a semi-circular recess. The interior surface and the semi-circular recess of the second piece is complementary to the interior surface and the semicircular recess of the first piece, respectively, such that the semi-circular recesses combine to form a circular bore, which closely captures a portion of the crankshaft located between the first and second eccentrics.

29 Claims, 12 Drawing Sheets

FIG. 16
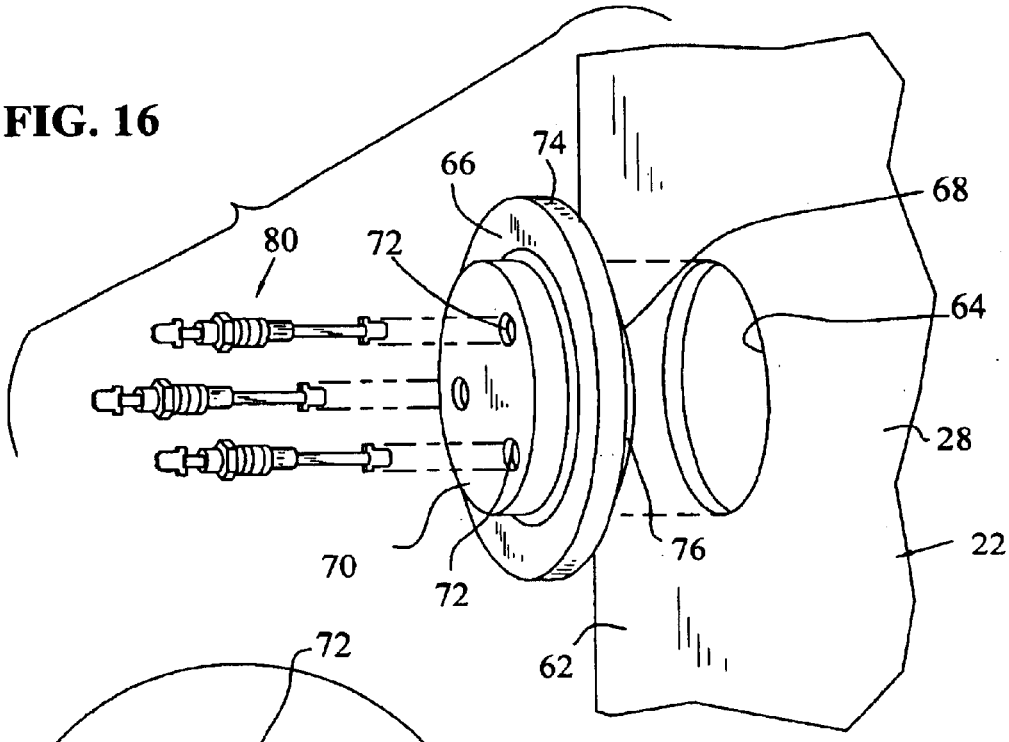
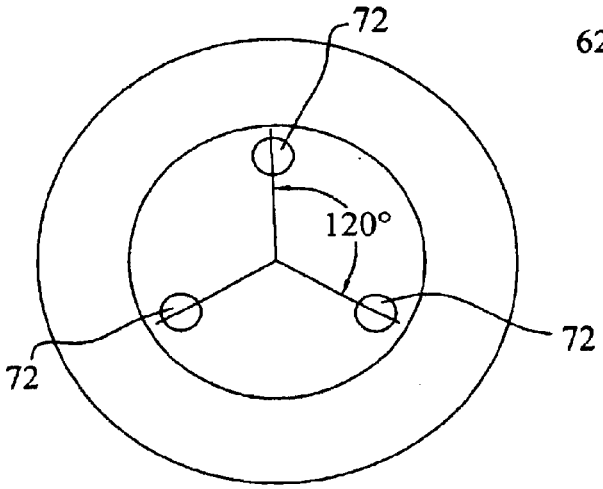
FIG. 17
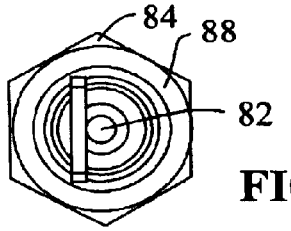
FIG. 19
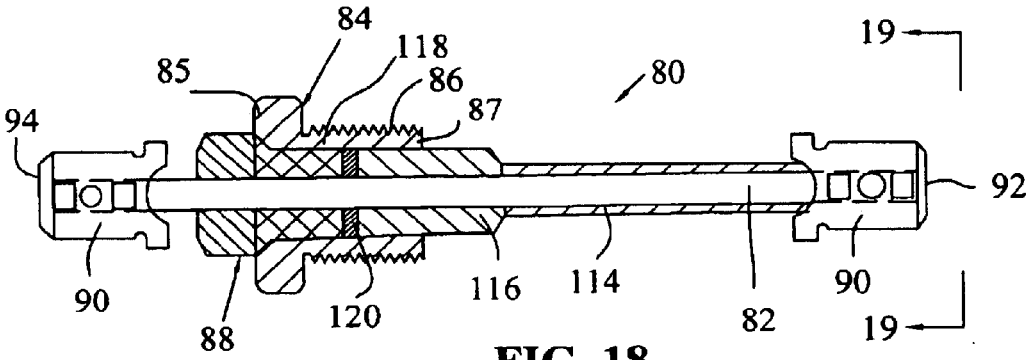
FIG. 18

ROTARY COMPRESSOR HAVING TWO-PIECE SEPARATOR PLATE

BACKGROUND OF THE INVENTION

1. Field of the Invention

The present invention pertains to hermetically sealed, positive displacement compressors for use in refrigeration systems such as air conditioners, refrigerators and the like, and methods for assembling such compressors.

2. Description of the Related Art

Various types of positive displacement compressors have been used in refrigeration systems including, for example, reciprocating piston rotary vane, and scroll type compressors. In addition, multi-cylinder compressors, such as twin cylinder rotary compressors, are also known in the art. In general, twin cylinder rotary compressors comprise a housing containing a motor and a compression mechanism. The compression mechanism includes two cylinders, each defining a bore. The motor generally includes a crankshaft that extends through the two cylinders and has two eccentric portions, one located in the bore of each cylinder. The crankshaft is driven by the rotor of a motor having a stator which is connected to a power source via a terminal assembly. The motor rotates the crankshaft which, in turn, rotates the eccentric portions within the bores of the cylinders. Each eccentric portion has a roller piston rotatably mounted thereon, which revolves within the bore and cooperates with one or more sliding vanes and the cylinder wall to provide a pumping action for compressing a refrigerant within the cylinder bore.

Terminal assemblies, as described above, provide power to the stator. Prior terminal assemblies, generally, include a terminal body and a plurality of conductor pins. The terminal body is typically cup-shaped and is mounted in an aperture within the wall of the compressor housing. The terminal body has a plurality of holes each defined by a collar or annular lip. The conductor pins extend through and are secured within the holes by the annular lip and an insulating glass seal, which electrically insulates the pins from the terminal body. The interior ends of the conductor pins are connected to lead wires running to the stator and the exterior ends of the conductor pins are connected to a source of electrical power.

In order to prevent refrigerant leakage and accommodate the high pressures within the compressor, parts of the compressor are machined to extremely close tolerances and the compressor housing is hermetically sealed. In the case of the terminal assembly, the terminal body of the assembly is tightly fitted within an aperture of the compressor housing and is then sealed to the wall of the housing, typically by welding, brazing or the like. Ideally, terminal assemblies are assembled prior to mounting and welding the terminal body to the housing. However, the cup-shaped terminal body of prior terminal assemblies are often unable to withstand the high heat of welding or brazing. Consequently, the subsequent welding of the pre-assembled terminal assembly to the housing often results in damage to the terminal body, insulators and/or the conductive pins. In addition, the interior of compressors using carbon dioxide as a working fluid reaches substantially high temperatures and pressures. Prior terminal assemblies, particularly the mounting of the conductive pins within the holes of the terminal body, are often unable to withstand the high pressures created in these compressors. Therefore, a need remains for a terminal assembly that can better endure the welding process by which the terminal assembly is fixed to the compressor housing and is better able to withstand the higher pressures and temperatures experienced in a hermetic compressor using carbon dioxide as the refrigerant.

In addition, prior compressors often required extensive machining of the housing and the housing aperture to achieve a tight fit between the terminal body and the aperture of the housing. Such extensive machining adds difficulty, time and expense to the assembly process. Therefore a need remains for a terminal assembly that can be installed on the housing without the need for extensive machining of the housing.

Further, in certain twin cylinder rotary compressors the two cylinders are adjacent to one another and a partition plate is disposed between the two cylinders, thereby separating the bores of each cylinder from one another. The partition plate includes a central aperture through which the crankshaft is inserted. Assembling such a compressor can be significantly difficult, expensive and time consuming, because the partition plate must be mounted on the first cylinder after the first eccentric is positioned on the crankshaft, but before the second eccentric is positioned on the crankshaft. In addition, during assembly the partition plate slides down the shaft into position on top of the first cylinder. Such a method, quite possibly, lessens the ability to achieve the high tolerance and close fit necessary to withstand the pressures in the cylinders. Therefore, a need also remains for a compressor having a separator plate that, during assembly, can be easily installed such that the plate closely encircles the crankshaft between adjacent shaft eccentric portions and a method for assembling such a compressor.

SUMMARY OF THE INVENTION

The present invention provides a twin cylinder rotary compressor including first and second cylinders; a crankshaft having first and second eccentrics mounted thereon, the first eccentric disposed within the first cylinder, the second eccentric disposed within the second cylinder; and a separator plate disposed between the first and second cylinders and having a first piece and a complementary second piece. Each of the first and second pieces includes an interior surface defining a semi-circular recess. The interior surface and the semi-circular recess of the second piece is complementary to the interior surface and the semicircular recess of the first piece, respectively, such that the semi-circular recesses combine to form a circular bore, which closely captures a portion of the crankshaft located between the first and second eccentrics.

In a related aspect of the present invention, the separator plate includes a dowel having a first end received in a dowel hole in the interior surface of the first piece and a second opposite end received in an opposite dowel hole in the interior surface of the second piece, thereby securely joining the first and second pieces.

In another related aspect of the present invention, the separator plate includes a threaded fastener, which extends through a clearance aperture in the second piece and engages a threaded aperture defined in the interior surface of the first piece, thereby securely joining said first and second pieces. The fastener may include a head portion and the second piece may include an annular surface defining a notch. The clearance aperture is defined in the notch and the head portion of the fastener received in the notch.

In still a further aspect of the present invention, each of the first cylinder, second cylinder, and separator plate includes a set of clearance holes. Each of the sets of clearance holes are aligned with one another and each of the aligned clearance holes receive one of a plurality of fasteners.

In yet another related aspect of the present invention, the twin cylinder rotary compressor further includes a main bearing having a set of threaded holes in alignment with each of the set of clearance holes of the first cylinder, second cylinder, and separator plate. Each one of the aligned threaded holes receives one of the plurality of fasteners, thereby mounting the first cylinder, second cylinder, and two-piece separator onto the main bearing.

The present invention further provides a twin cylinder rotary compressor including first and second cylinders and a separator plate disposed between the first and second cylinders. The separator plate includes a first piece and a complementary second piece, each of the first and second pieces including an interior surface defining a semi-circular recess. The interior surface and the semi-circular recess of the second piece are complementary to the interior surface and the semicircular recess of the first piece, respectively, such that the semi-circular recesses combine to form a circular bore.

The present invention also provides a separator plate for a twin cylinder rotary compressor having first and second cylinders, and a crankshaft extending through the first and second cylinders and having first and second eccentrics mounted thereon. The separator plate includes a first piece and a complementary second piece. The first piece and the second complementary piece disposed between the first and second cylinders and each of the first and second pieces includes an interior surface defining a semi-circular recess. The interior surface and the semi-circular recess of the second piece is complementary to the interior surface and the semicircular recess of the first piece, respectively, such that the semi-circular recesses combine to form a circular bore. The circular bore is adapted to closely encompass a portion of the crankshaft located between the first and second eccentrics.

Furthermore, the present invention provides a method of assembling a twin cylinder rotary compressor including the step of assembling a compressor sub-assembly by mounting a second cylinder on a main bearing; inserting a crankshaft having first and second eccentrics mounted thereon, into the second cylinder and main bearing; positioning first and second pieces of a separator plate on the second cylinder and around the crankshaft such that a semicircular recess in an interior surface of the first piece pairs with a semicircular recess in an interior surface of the second piece to form a bore, and the bore closely encompasses a portion of the crankshaft located between the eccentrics; and mounting a first cylinder about the crankshaft and on the separator plate.

In a related aspect of the present invention, the step of assembling a compressor sub-assembly includes fastening the first and second pieces of the separator plate together by inserting one end of a dowel into a dowel hole in the interior surface of the first piece; and inserting an opposite end of the dowel into an opposite dowel hole in the interior surface of the second piece.

In another related aspect of the present invention, the step of assembling a compressor sub-assembly includes fastening the first and second pieces of the separator plate by inserting a threaded fastener through a clearance aperture in the second piece and engaging the fastener to a threaded aperture defined in the interior surface of the first piece.

Still further, the method of assembly according to the present invention may also include the step of mounting the compressor sub-assembly to a motor by fastening a stator of the motor to the main bearing of the sub-assembly.

In another aspect of the present invention, the method of assembly includes step of mounting the compressor sub-assembly in a housing by heat-expanding the housing, inserting the compressor sub-assembly into the housing and shrink-fitting the housing onto the compressor sub-assembly.

The present invention also provides a method of assembling a twin cylinder rotary compressor including the steps of assembling a compressor sub-assembly by mounting a second cylinder on a main bearing, positioning first and second pieces of a separator plate on the second cylinder such that a semicircular recess in an interior surface of the first piece pairs with a semicircular recess in an interior surface of the second piece to form a bore; and mounting a first cylinder on the separator plate; attaching the sub-assembly to a motor to produce a motor-compressor assembly; and mounting the motor-compressor assembly in a housing.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein:

FIG. 16 is an exploded view of the terminal block assembly of FIG. 14 in relation with the housing of a hermetic compressor according to the present invention;

FIG. 17 is a plan view of the terminal block assembly of FIG. 14;

FIG. 18 is an enlarged sectional view of a pin assembly according to the present invention;

FIG. 19 is an end view of the pin assembly of FIG. 18 along lines 19—19;

DETAILED DESCRIPTION

The embodiments disclosed herein are not intended to be exhaustive or limit the invention to the precise forms disclosed in the following description. Rather the embodiments are chosen and described so that others skilled in the art may utilize its teachings.

Figure 1:
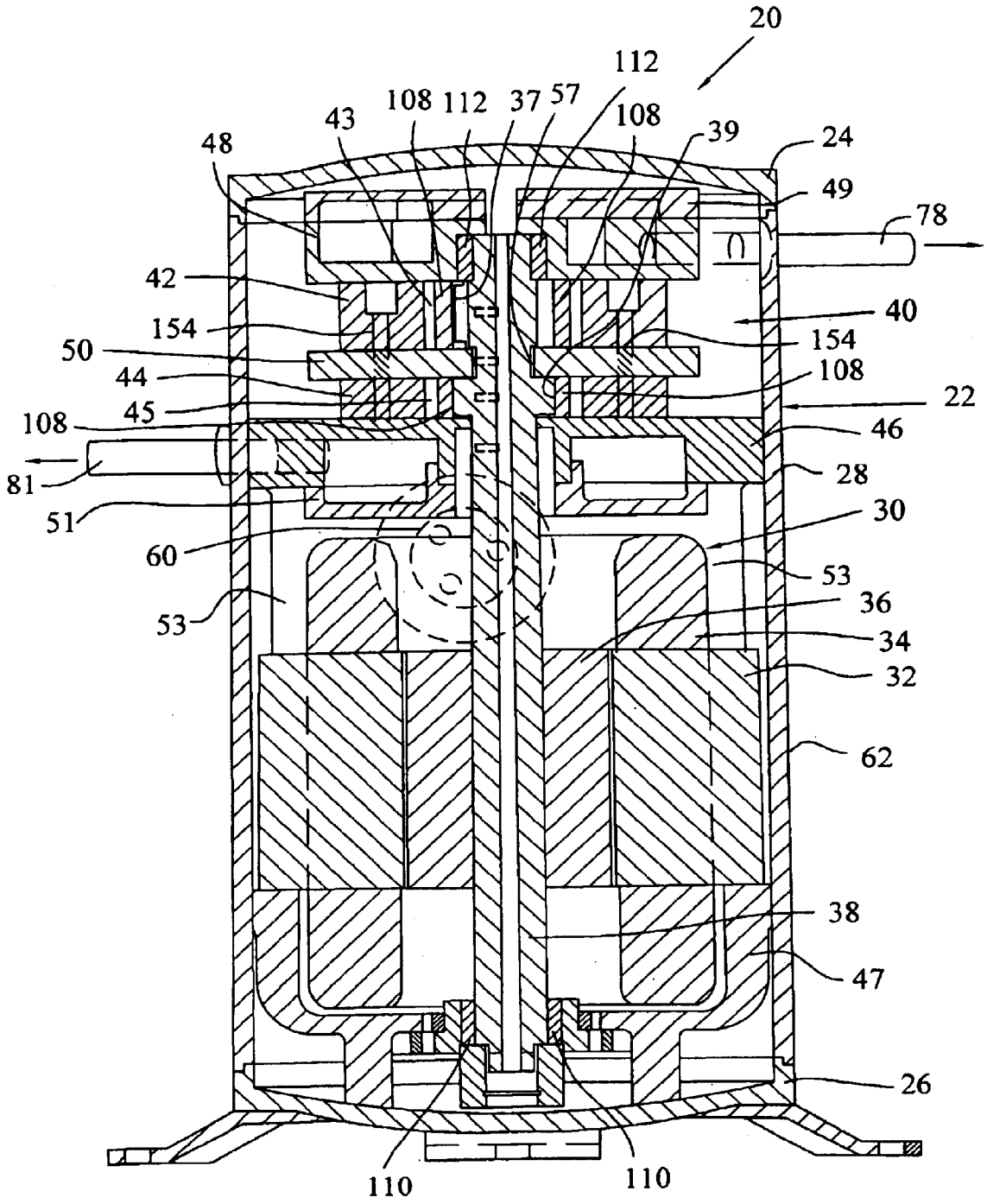
FIG. 1 is a first sectional view of a hermetic compressor according to the present invention.

Referring to FIG. 1, hermetic compressor 20 comprises housing 22 which includes upper housing 24, lower housing 26, and cylindrical main housing 28. As better illustrated in FIG. 16, aperture 64 is defined in wall 62 of main housing 28. Returning now to FIG. 1, housing portions 24, 26 and 28 are formed of sheet steel and hermetically sealed by a method such as welding, brazing, or the like. Alternatively, either upper housing 24 or lower housing 26 may be integrally-formed with main housing 28. Disposed within housing 22 is motor 30 and compression mechanism 40. Motor 30 includes rotor 36, which is surrounded by stator 32 and fixed to crankshaft 38. Stator 32 includes windings 34, which are connected by lead wires (not shown) to a power source (not shown) via terminal assembly 60. Stator 32 is secured at one end to legs 53 of crankcase or main bearing 46 and at the opposite end to lower outboard bearing 47. Discharge muffler 51 is disposed between main bearing 46 and motor 30.

Figure 2:
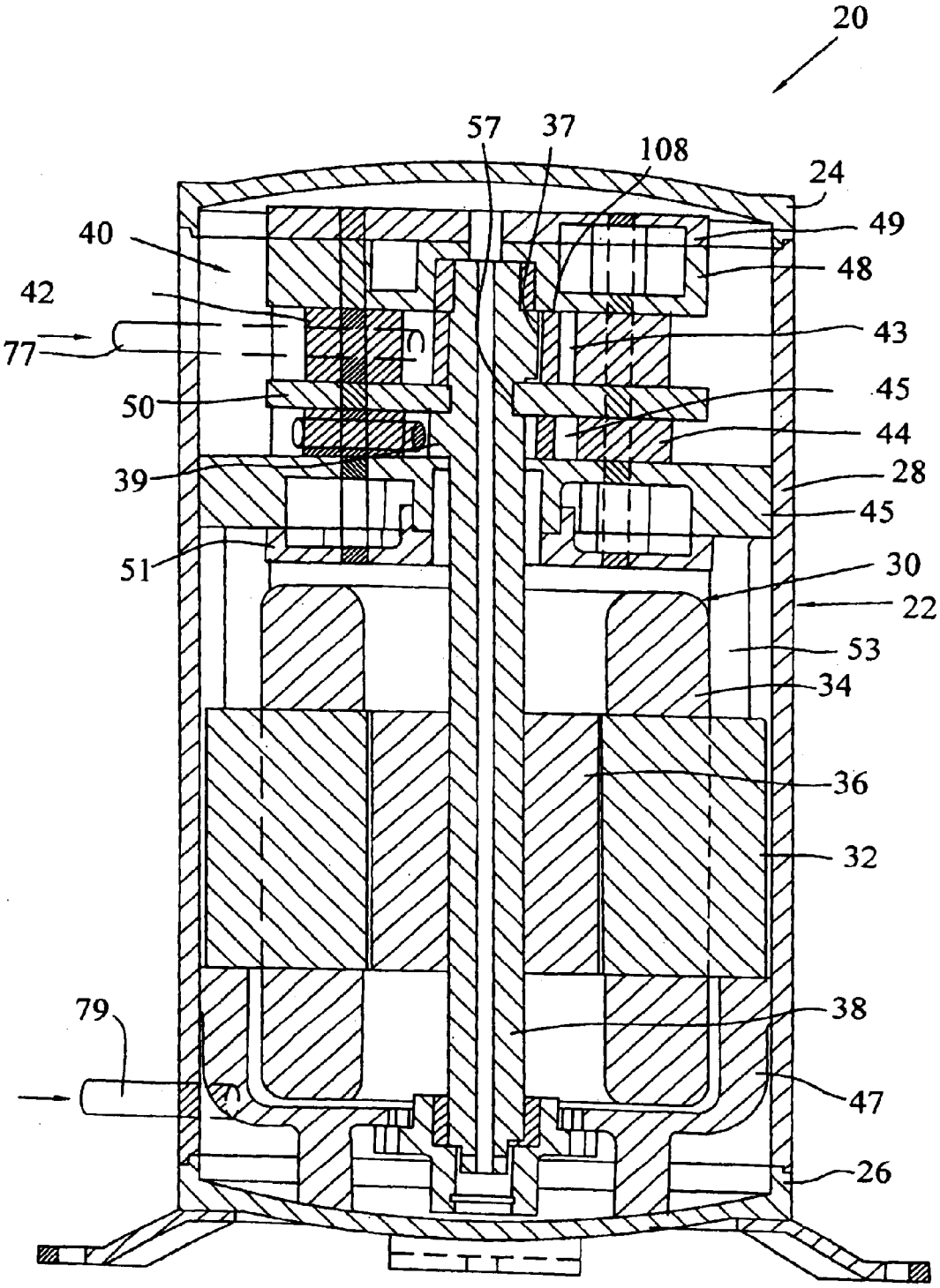
FIG. 2 is a second sectional view of the hermetic compressor of FIG. 1.
Figure 3:
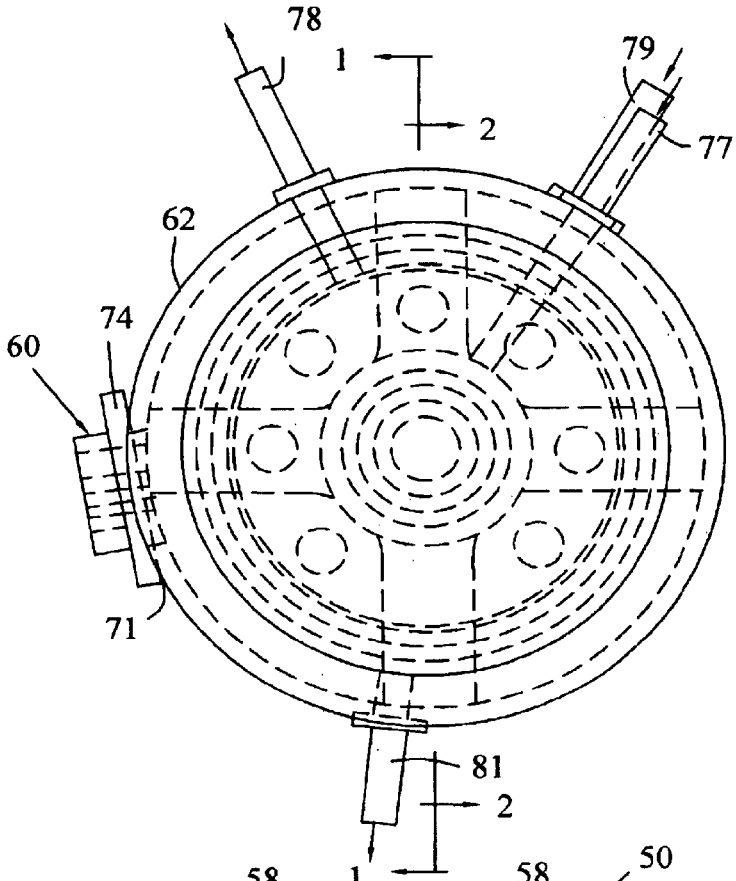
FIG. 3 is a top view of the compressor of FIG. 1.

Compression mechanism 40 includes first cylinder 42 and second cylinder 44, each having a cylindrical chamber 43 and 45, respectively. First and second cylinders 42, 44 are separated by separator plate 50, which has a central bore 57. Chamber 43 of first cylinder 42 receives gas, which may be, for example, carbon dioxide or any other suitable refrigerant, at substantially suction pressure, through intake tube 77. Intermediate pressure muffler 49 is disposed on upper outboard bearing 48 and upper outboard bearing 48 is disposed adjacent first cylinder 42. Upper outboard bearing 48 includes intermediate discharge tube 78, which is in communication with chamber 43 of first cylinder 42. Intermediate discharge tube 78 is also in communication with chamber 45 of second cylinder 44 through intermediate suction tube 79 (FIGS. 2 and 3). Intermediate discharge tube 78 and intermediate suction tube 79 are in fluid communication with each other externally of housing 22, and may comprise a common conduit.

Figure 12:
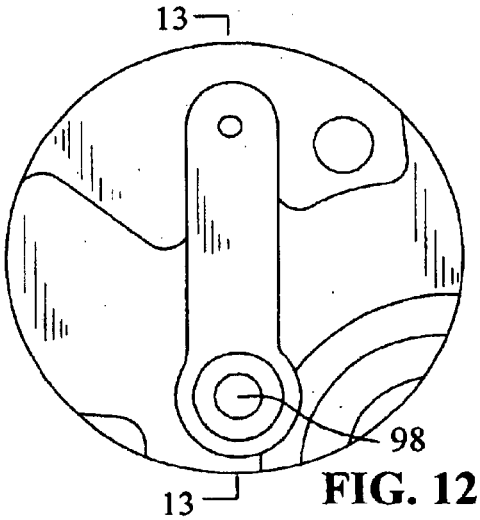
FIG. 12 is an enlarged view of the encircled region of the crankcase of FIG. 7.
Figure 13:
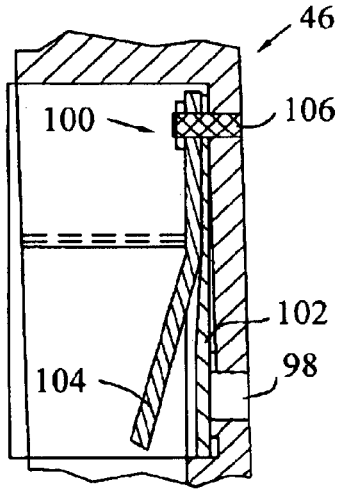
FIG. 13 is an enlarged, fragmentary sectional view of the crankcase of FIG. 7 taken along lines 13—13.
Figure 14:
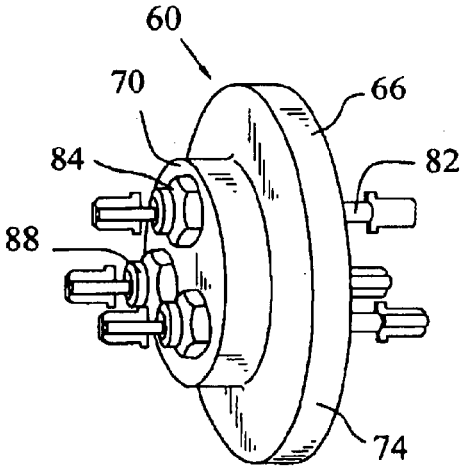
FIG. 14 is a perspective view of a terminal block assembly according to the present invention.
Figure 9:
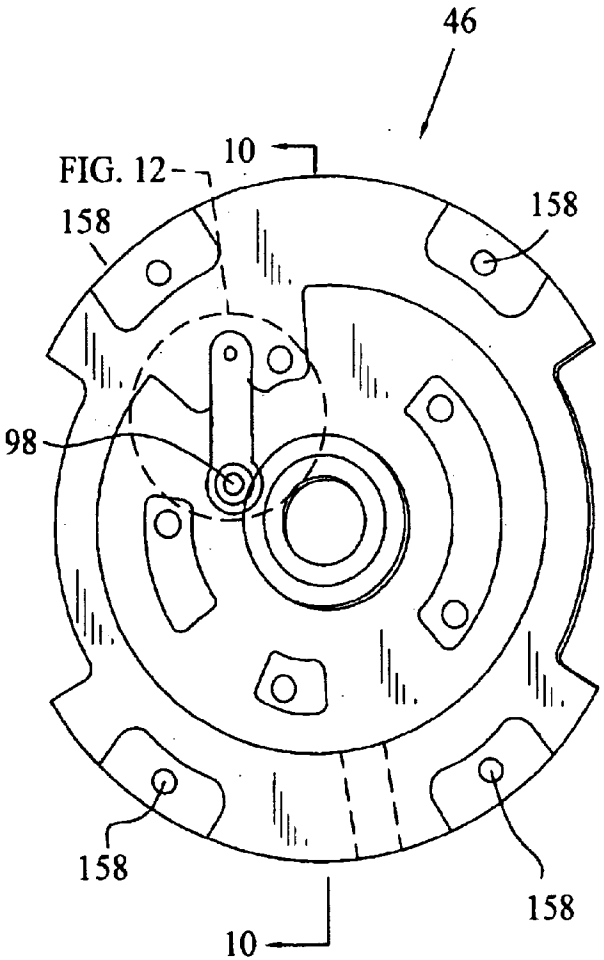
FIG. 9 is a bottom view of the crankcase of FIG. 7.
Figure 20:
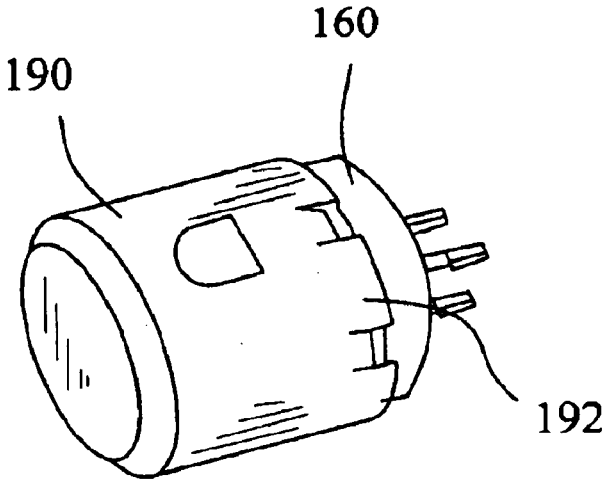
FIG. 20 is a perspective view of a second embodiment terminal assembly and protective cover according to the present invention.

Second cylinder 44 is disposed adjacent to main bearing 46 and chamber 45 is in communication with discharge muffler 51 through valve opening 98 in main bearing 46 (FIGS. 9, 12 and 13). Referring to FIGS. 9, 12 and 13, valve opening 98 is equipped with a valve assembly 100 that includes resilient valve 102 sealing valve opening 98 and valve stop 104. Valve assembly 100 is secured to main bearing 46 by fastener 106. Referring back to FIGS. 1–3, discharge tube 81 is in communication with discharge muffler 51. Crankshaft 38 extends through chamber 45, bore 57, and chamber 43, and includes two eccentric portions 37, 39 mounted thereon which are disposed inside chambers 43 and 45, respectively. Roller bearings 108 provide radial support to eccentric portions 37, 39 and further seal any space between the wall of bore 57 and crankshaft 38. Crankshaft 38 is radially supported at either end in lower outboard bearing 47 and upper outboard bearing 48 by needle roller bearings 110, 112, which prevent deflection of crankshaft 38.

Turning now to FIGS. 1–3, in operation, compressor 20 receives suction pressure gas into first compression chamber 43 through tube 77, where it is compressed to an intermediate pressure and discharged into intermediate pressure muffler 49. The intermediate pressure gas is then discharged externally from compressor 22 through intermediate discharge tube 78, which extends from outboard bearing 48 and through housing 22. The intermediate pressure gas is then introduced into the motor compartment through intermediate pressure suction tube 79, and is drawn into second compression chamber 45 and compressed to discharge pressure. Referring now to FIGS. 1–3 and 13, the discharge pressure gas is discharged into discharge muffler 51 from second compression chamber through valve opening 98 in main bearing 46. More specifically, when pressure reaches a certain predetermined limit, the pressure of the discharge pressure gas forces valve 102 to deflect away from main bearing 46, thereby exposing valve opening 98 to discharge muffler 51. The deflection of valve 102 is limited by valve stop 104. The discharge gas is then expelled from the compressor assembly through discharge tube 81, which extends from main bearing 46 and through housing 22. The displacement volume ratio of intermediate pressure gas to discharge pressure gas is approximately 1:10.

Figure 5:
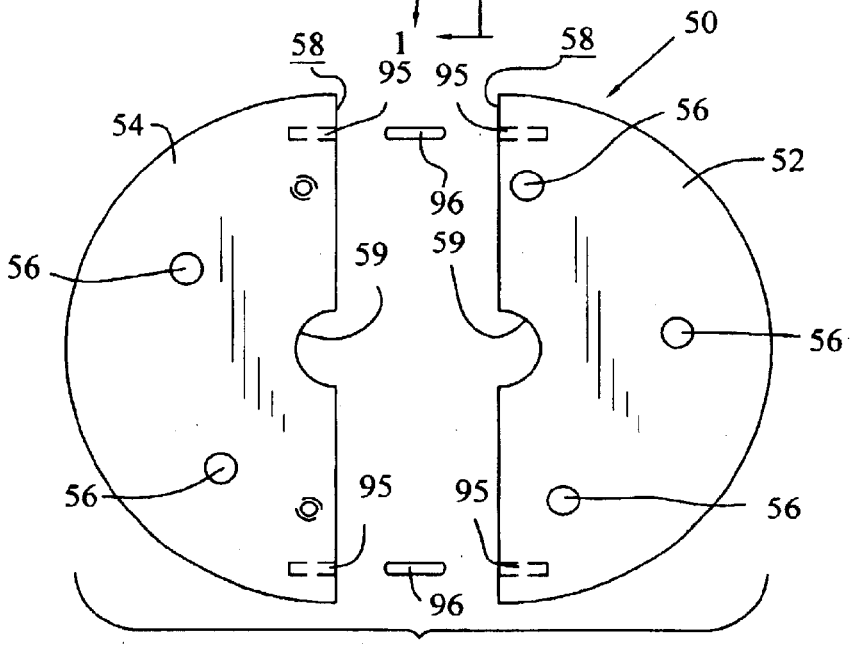
FIG. 5 is a top view of a two-piece separator plate according to one embodiment of the present invention.
Figure 5A:
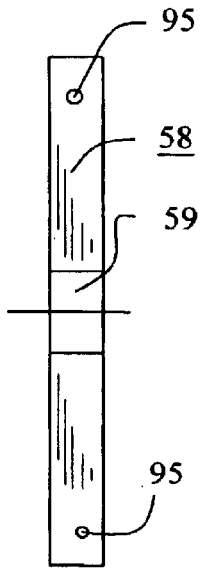
FIG. 5A is an interior side view of either piece of the separator plate of FIG. 5.

According to one embodiment of the present invention shown in FIG. 5, separator plate 50 is a two-piece separator plate having a first piece 52 and a second, complementary piece 54. As illustrated in FIGS. 5 and 5A, each of first and second pieces 52, 54 includes planar surface 58 having semi-circular central recess 59. First and second pieces 52, 54 may be paired by joining planar surfaces 58 and fastening first and second pieces using dowel 96, the ends of which are received within dowel holes 95. When first and second pieces 52, 54 are paired, semi-circular recesses 59 form bore 57, which is sized to closely surround crankshaft 38 at a location between the eccentrics. Two-piece separator plate 50 also includes bolt clearance holes 56. The two-piece plate design allows the separator plate 50 to be fitted more closely around the portion of crankshaft 38 located between eccentrics 37, 39 and sealably separate compression chambers 43 and 45.

Figure 6A:
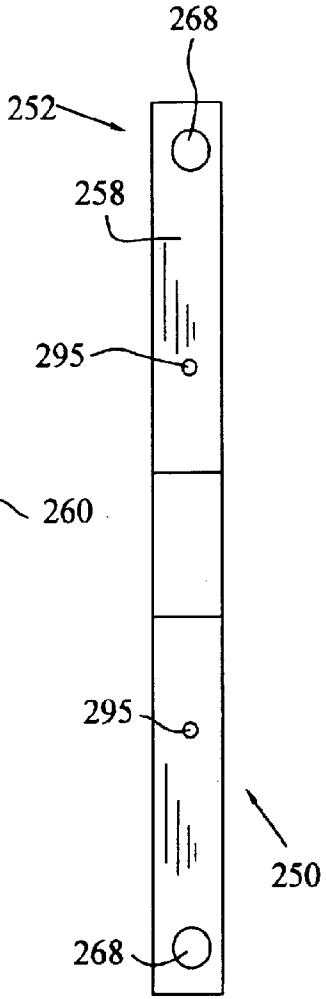
FIG. 6A is an interior side view of a first piece of the separator plate of FIG. 6.
Figure 6:
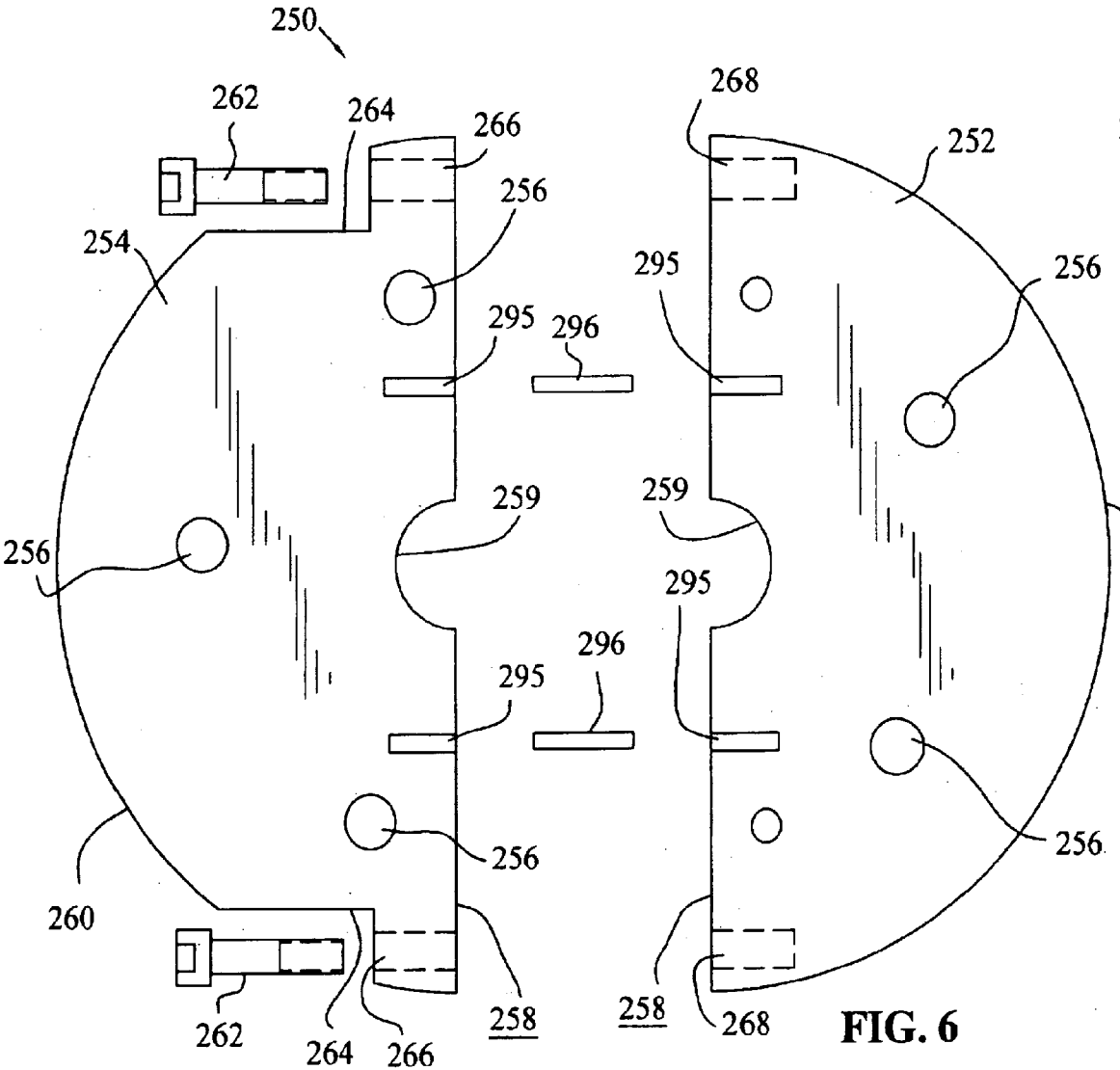
FIG. 6 is a top view of a two-piece separator plate according to another embodiment of the present invention.

According to another embodiment of the present invention shown in FIG. 6, separator plate 250 is a two-piece separator plate having a first piece 252 and a second, complementary piece 254. As illustrated in FIGS. 6 and 6A, each of first and second pieces 252, 254 includes annular surface 260 and planar surface 258 having semi-circular central recess 259. First and second pieces 252, 254 may be paired by joining planar surfaces 258 and fastening first and second pieces 252, 254 using dowel 296, the ends of which are received within dowel holes 295. Alternatively, or additionally, first and second pieces 252, 254 may be secured using fasteners 262, which extend through clearance apertures 266 in second piece 254 and engage threaded apertures 268 defined in interior surface 258 of first piece 252. Notches 264 may be defined in annular surface 260 of second piece 254 for receiving fasteners 262 and for housing the head of fasteners 262 within the diametric perimeter of annular surface 260. Two-piece separator plate 250 also includes bolt clearance holes 256.

In assembling compressor 20 according to the present invention, main bearing 46 is placed on a holding device with the upper side 33 facing up. Second cylinder 44 is then placed on the upper side 33 of main bearing 46 and crankshaft 38 is inserted into main bearing 46 and second cylinder 44. Roller bearing 108 is mounted on crankshaft 38 within chamber 45. First and second pieces 52, 54 of separator plate 50 are then positioned on top of second cylinder 44 and paired such that semi-circular central recesses 59 closely capture the portion of crankshaft 38 located between eccentrics 37, 39. First and second pieces 52, 54 are connected to one another using dowels 96, the ends of which are inserted into holes 95 (FIG. 5). Alternatively, first and second pieces 252, 254 of separator plate 250 may be positioned on top of second cylinder 44 and paired such that semi-circular central recesses 259 closely capture the portion of crankshaft 38 located between eccentrics 37, 39. First and second pieces 252, 254 may then be connected to one another using dowels 296 and/or fasteners 262. Roller bearing 108 is mounted on crankshaft 38 and first cylinder 42 is then positioned on separator plate 50 such that roller bearing is disposed within chamber 43.

Figure 7:
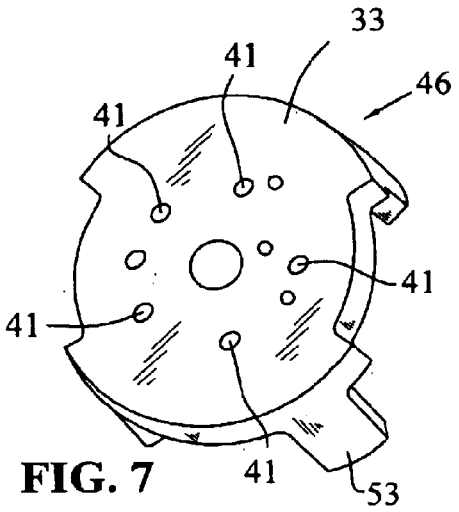
FIG. 7 is a top perspective view of a crankcase according to the present invention.

Outboard bearing 48 and intermediate discharge muffler 49 are then positioned atop first cylinder 42 and five bolts (represented by dashed lines 154 in FIG. 1) are placed through clearance holes in intermediate discharge muffler 49, outboard bearing 48, first cylinder 42, two-piece separator plate 50, and second cylinder 44, and engage threaded holes 41 (FIG. 7) in the upper side 33 of main bearing 46. Next, main bearing 46 is removed from the holding device and annular discharge muffler 51 is positioned on the underside 35 of main bearing 46 between legs 53. Five bolts are then inserted through clearance holes in discharge muffler 51 and engage one end of threaded holes 41 at the underside 35 of main bearing 46 (FIG. 8) to secure discharge muffler 51 to main bearing 46. Alternatively, the five bolts 154 extending through intermediate discharge muffler 49, outboard bearing 48, first cylinder 42, two-piece separator plate 50, second cylinder 44, and holes 41 can be lengthened to further extend completely through holes 41 and discharge muffler 51 and can be secured with nuts.

Figure 8:
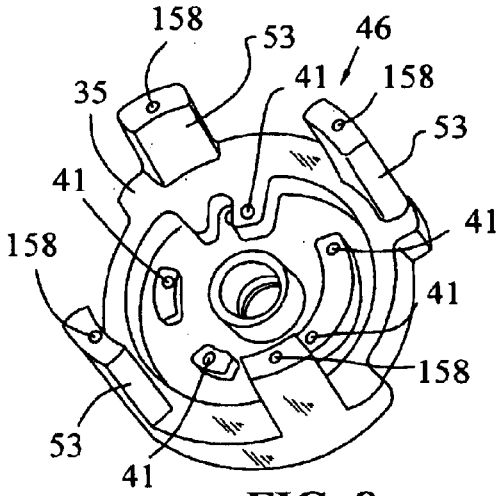
FIG. 8 is bottom perspective view of the crankcase of FIG. 7.

Crankshaft 38 is then affixed to rotor 36 by heat-shrinking. Stator 32 is then placed over rotor 36, and outboard bearing 47 is positioned over the end of stator 32 and rotor 36. Four threaded bolts or like fasteners (not shown) are inserted into clearance holes (not shown) provided in outboard bearing 47 and stator 32. Bolts are then threaded into four threaded holes 158 provided in the ends of legs 53 of main bearing 46 (FIG. 8).

Figure 4:
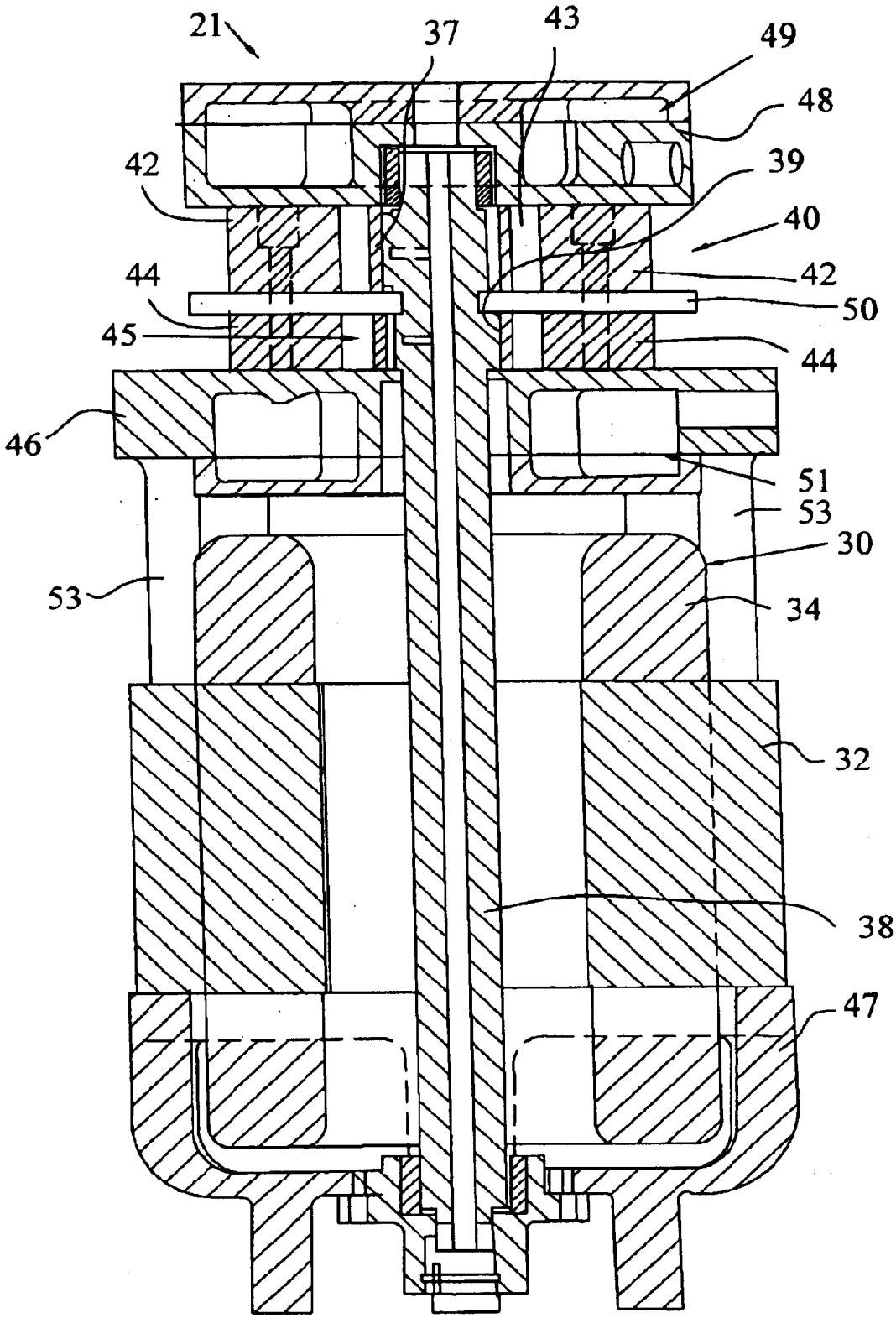
FIG. 4 is a sectional view of the compressor sub-assembly (without the housing) of FIG. 1

The resulting compressor sub-assembly 21, shown in FIG. 4, is then installed in housing 22 by, first, heat-expanding main housing 28, and inserting compressor subassembly 21 into main-housing 28 (FIG. 1). Main housing 28 can then be shrink-fitted onto sub-assembly 21, such that sub-assembly 21 is in contact with the housing at the peripheries of main bearing 46 and outboard bearing 47. The upper and lower housing portions are then welded to the main housing portion 28 to hermetically seal compressor 20. Tubes 77, 78, 79, and 81 are then inserted into openings (not shown) in housing 28 such that the inner portion of tubes 77, 78, 79 and 81 extend into openings (not shown) in first cylinder 42, outboard bearing 48, outboard bearing 47 and main bearing 46, respectively. The openings in first cylinder 42, outboard bearing 48, outboard bearing 47 and main bearing 46 are provided with a seal, such as an o-ring, to sealingly receive tubes 77, 78, 79 and 81. The outer portion of tubes 77, 78, 79 and 81 are then sealed to housing 38 by welding, brazing or the like.

Figure 15:
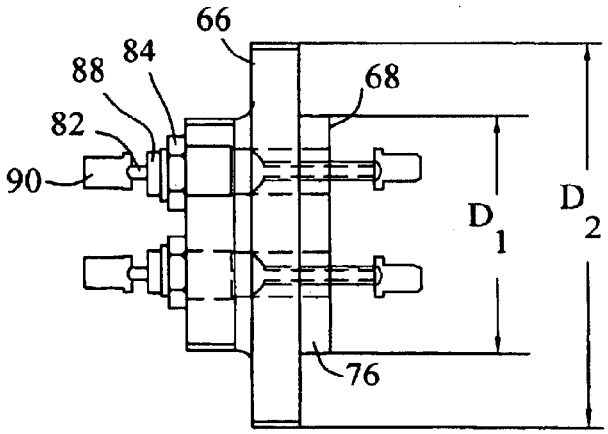
FIG. 15 is a side view of the terminal block assembly of FIG. 14.
Figure 11:
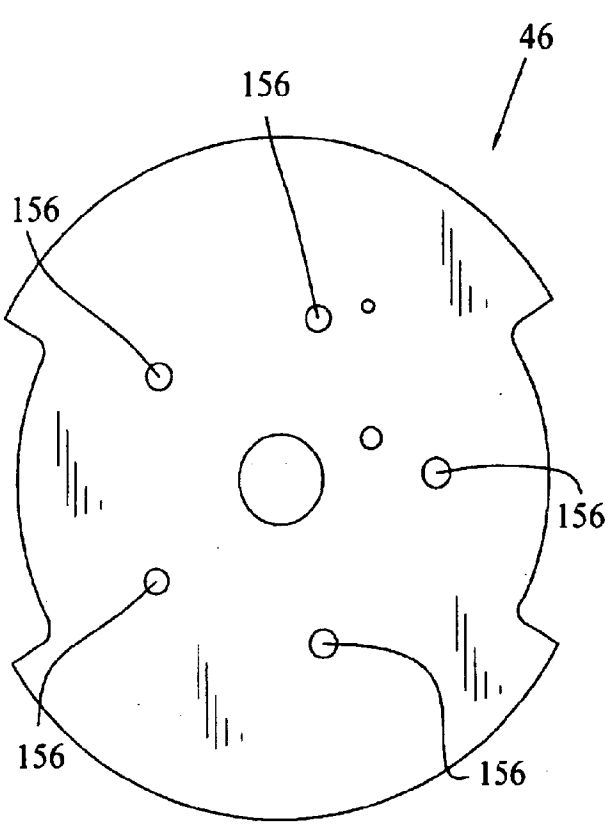
FIG. 11 is a top view of the crankcase of FIG. 7.
Figure 10:
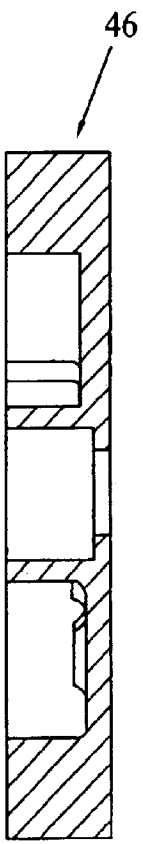
FIG. 10 is a sectional view of the crankcase of FIG. 7 taken along lines 10—10.

With reference to FIGS. 14–19, according to one embodiment of the present invention, terminal assembly 60 generally includes machined metallic disk 66 and three pin assemblies 80. Disk 66 includes three equally spaced-apart, threaded holes extending therethrough. Referring particularly to FIGS. 15 and 16, interior side 68 of disk 66 defines a first diameter portion 76 having diameter $D_1$ sized to snugly fit within aperture 64 in wall 62 of housing 22. Disk 66 also includes a second diameter portion 74 adjacent first diameter portion 76 and having diameter $D_2$, which is larger in diameter than both $D_1$ and aperture 64. As shown in FIGS. 3 and 16, first diameter portion 76 of disk 66 fits into aperture 64. Second diameter portion 74 abuts wall 62, thereby restricting further movement of disk 66 into aperture 64 and providing a sealing region 71 between the surface of second diameter portion 74 and housing wall 62. Disk 66 is hermetically sealed to housing wall 62 at sealing region 71 by welding, brazing or other means.

Turning now to FIGS. 18 and 19, each pin assembly 80 includes an elongate conductive pin 82, electrical insulator 88 disposed about pin 82, annular collar 84 disposed about a portion of electrical insulator 88, and tabs 90 positioned at both the stator end 92 and power source end 94 of pin 82. Electrical insulator 88 includes Teflon® sleeve 114 extending along a length of pin 82 at stator end 92, sintered glass portions 116, and a fused glass portion 118. Between fused glass portion 118 and one of the sintered glass portions 116 is freon-proof epoxy resin 120, and parts of both fused glass portion 118 and sintered glass portion 116 are disposed between pin 81 and annular collar 84. Annular collar 84 includes hexagonal head portion 85 and shaft portion 87, which includes threaded outer surface 86. Each pin assembly 80 is received in,a corresponding one of threaded holes 72 in disk 66 and is secured in hole 72 via a threaded engagement between threaded collar surface 86 and threaded surface of hole 72. In this threaded engagement, pin assemblies 80 are more securely fixed in holes 72, and therefore, are capable of withstanding the high pressures created in carbon dioxide compressors.

As is typical in the art, the compressor end 92 of pin 82 may be connected to lead wires (not shown) extending from stator windings 34 via a connector clip, cluster block or other electrical connecting means. The power source end 94 of pin 82 is appropriately connected to a power source (not shown) to provide power to pin 82 and, ultimately, to stator 32.

Disk 66 is of substantial thickness, the overall thickness of disk 66 as measured between exterior side 70 and interior side 68 is, preferably, about one inch. However, thickness can vary, provided that disk 66 is thick enough to endure the heat of hermetic sealing and the pressures of carbon dioxide compression without damage or deformity to disk 66, pin assemblies 80, and/or lead wires (not shown). Second diameter portion 74, particularly, should be of substantial thickness, preferably, about 0.300 inches. First diameter portion 76 should have sufficient thickness to securely fit into aperture 64, preferably, about 0.200 inches.

This terminal assembly withstands the heat of welding and the pressures created in a carbon dioxide compressor, and therefore, provides a more robust compressor assembly design. In one embodiment of the present invention, the terminal assembly is assembled by, first, mounting metallic disk 66 on housing 22 by inserting first diameter portion 76 into aperture 64 until second larger diameter portion 74 of metallic disk 66 abuts outer wall 62 of housing 22. Then second diameter portion 74 is hermetically sealed to housing outer wall 62 by welding, brazing or other sealing means. Finally, terminal pin assemblies 80 are inserted into holes 72 and annular collars 84 are secured to hole 72 in a screw-type engagement.

Alternatively, the terminal assembly can be assembled prior to welding disk 66 to wall 62 of housing 22. In this case, terminal assembly 60 is assembled by, first, installing terminal pin assemblies 80 within holes 72, as described above. With the pin assemblies 80 threadedly secured in holes 72, metallic disk 66 is mounted in aperture 64 and second diameter portion 74 is hermetically sealed to outer wall 62 without causing damage to disk 66, pin assemblies 80 and/or lead wires.

Figure 21:
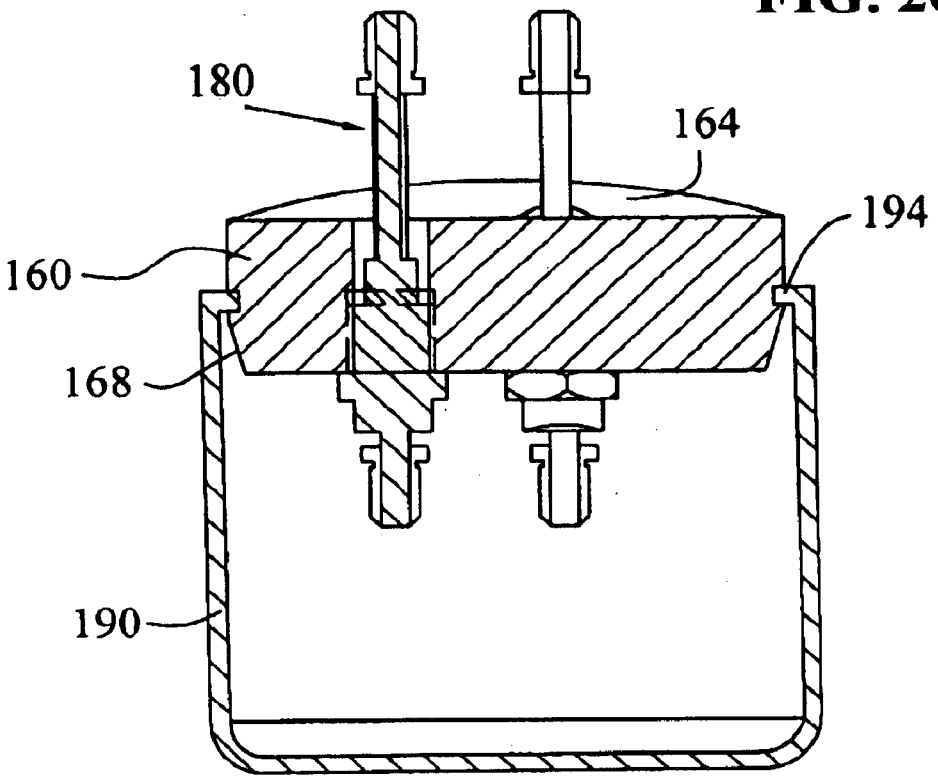
FIG. 21 is a sectional view of the terminal assembly and protective cover of FIG. 20.
Figure 23:
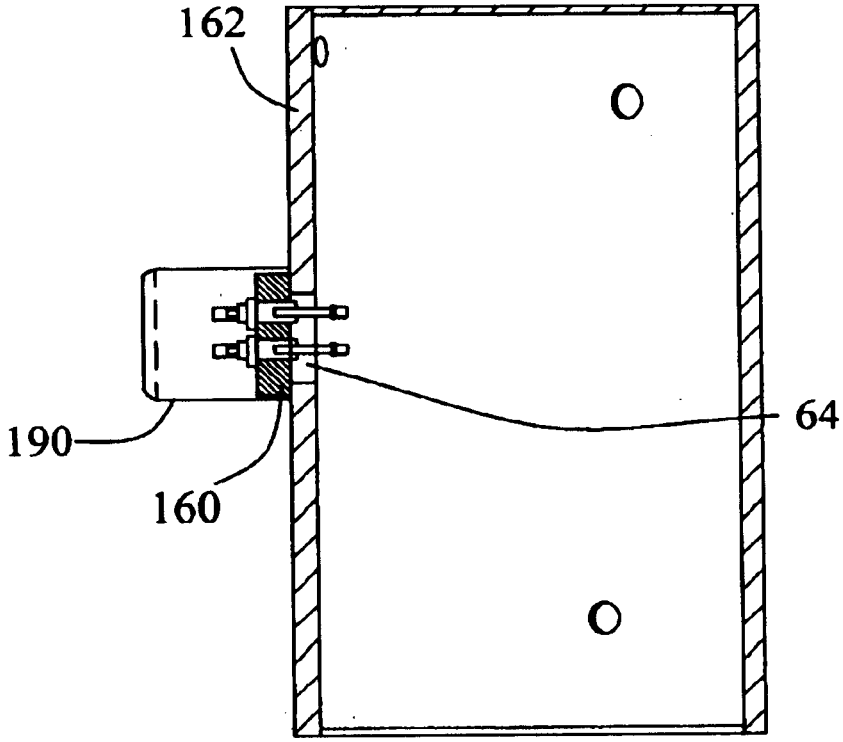
FIG. 23 is a sectional view of the terminal assembly and protective cover of FIG. 22 taken along lines 23—23.
Figure 22:
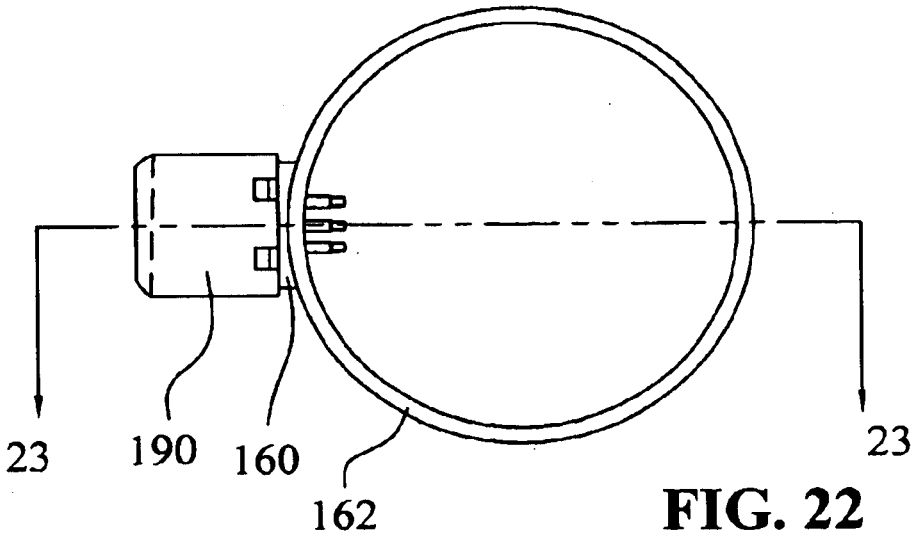
FIG. 22 is a top view of the terminal assembly and protective cover of FIG. 20 installed on a compressor housing according to the present invention.
Figure 24:
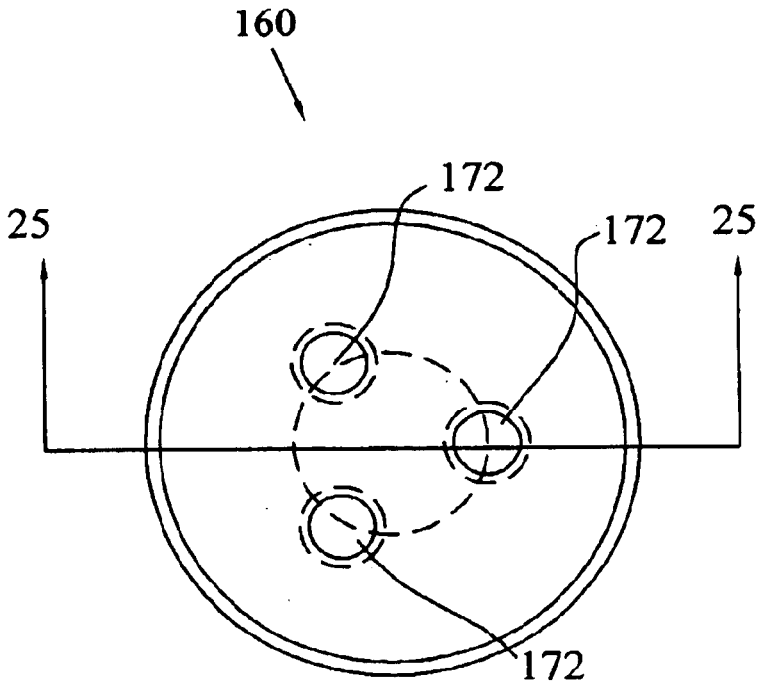
FIG. 24 is a plan view of the terminal block of the terminal assembly FIG. 20.

According to another embodiment of the present invention exemplified in FIGS. 20–27, terminal block 160 has a concave mating surface 164 having a radius of curvature that corresponds to the curvature of housing wall 162, such that mating surface 164 of terminal block 160 can lie flush against housing wall 162. Housing wall 162 may be substantially identical to housing wall 62 described herein above. Terminal block 160 is mounted on housing wall 162 by welding, brazing or the like. As can be seen in FIGS. 21 and 24, terminal block 160 also includes three equally-spaced, tapped and threaded holes 172 extending therethrough, which receive terminal pin assemblies 180 in a threaded-engagement as described above with respect to pin assemblies 80. Because terminal block 160 does not fit closely within aperture 164 in housing wall 162, tolerances of aperture 164 may be loosely held.

Figure 25:
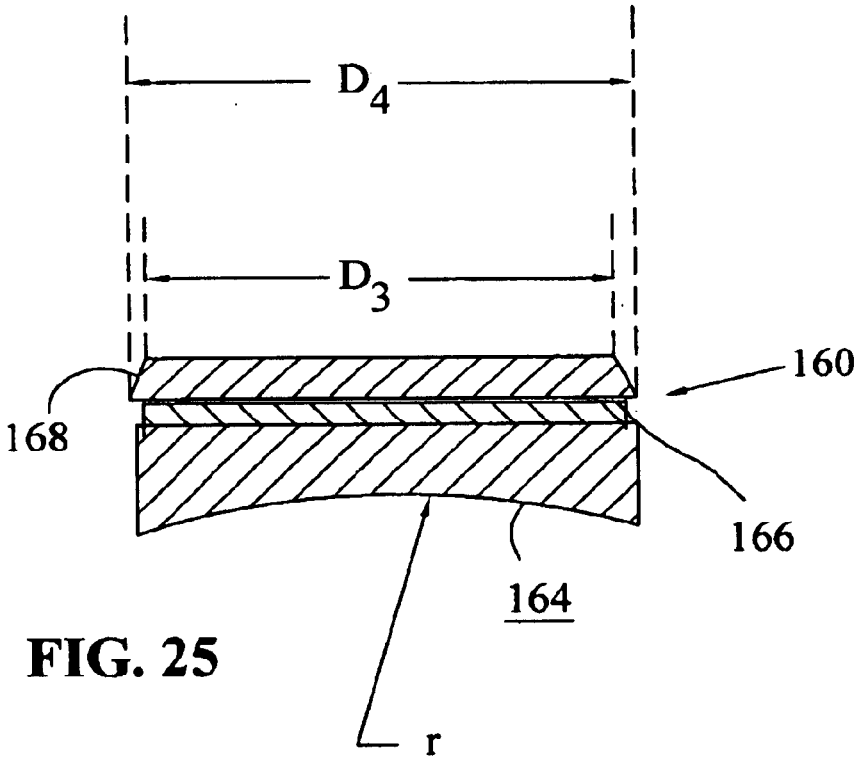
FIG. 25 is a sectional view of the terminal block of FIG. 24 taken along lines 25—25.
Figure 26:
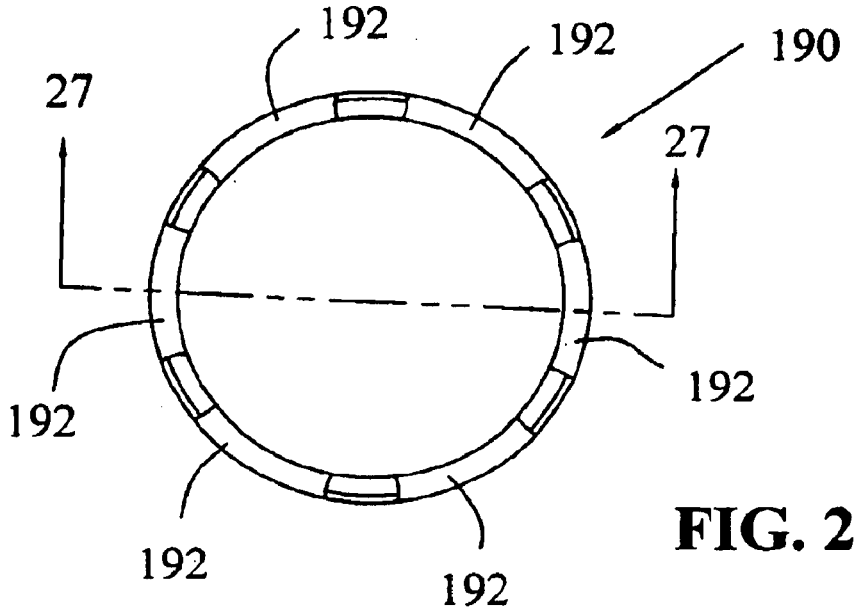
FIG. 26 is an interior plan view of the protective cover of FIG. 22.
Figure 27:
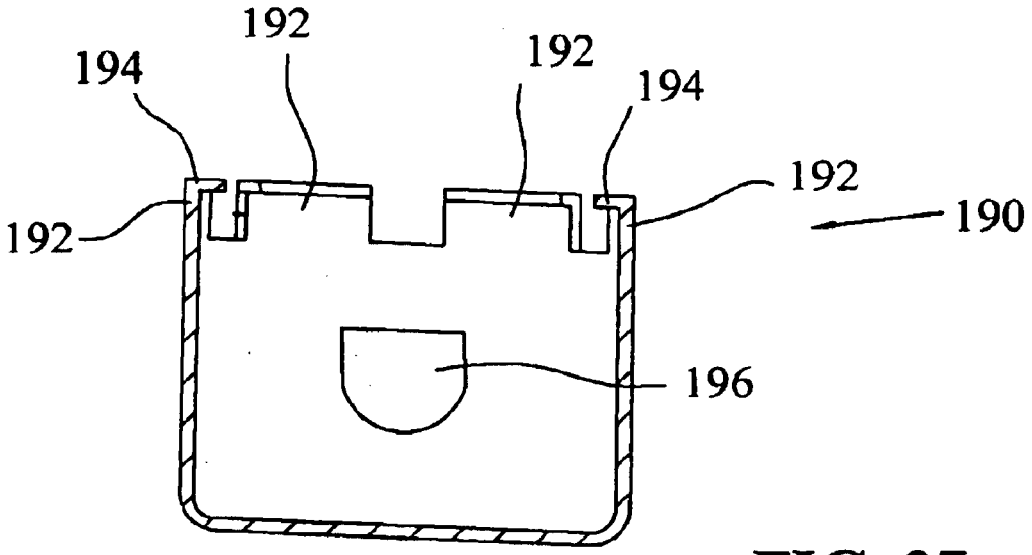
FIG. 27 is a sectional view of the protective cover of FIG. 26 taken along lines 27—27.

As illustrated in FIG. 25, terminal block 160 may also include annular grove 166 about a circumference of terminal block 160 and frustoconical guide surface 168 adjacent thereto, which slopes from a first diameter $D_3$ to a larger second diameter $D_4$ such that guide surface 164 is tapered. Both annular groove 166 and tapered guide surface 164 cooperate to receive a snap-fit protective cover, such as cover 190 illustrated in FIGS. 20–21 and 26–27. Cylindrical cover 190 may be formed of plastic or sheet metal, and includes six, equally spaced-apart, resilient legs 192. Each leg 192 includes lip 194 that is shaped and sized to fit within annular groove 166. To install cover 190 on terminal block 160, resilient legs 192 are urged along tapered guide surface 164, causing resilient legs 192 to flex outward. When lip 194 reaches groove 164, resilient legs 192 spring inwards, snapping lip 194 into groove 164, thereby locking cover 190 onto terminal block 160. Cover 190 also includes a D-shaped hole 196 through which a conduit wire assembly leading from the power source can extend. Cover 190 protects the terminal assembly from damage during operation and is relatively easy to install.

While this invention has been described as having an exemplary design, the present invention may be further modified within the scope of this disclosure. This application is therefor intended to cover any variations, uses, or adaptations of the invention using its general principles. Further, this application is intended to cover such departures from the present disclosure as come within known or customary practice in the art to which this invention pertains.

What is claimed is:

1. A twin cylinder rotary compressor comprising:

first and second cylinders;

a crankshaft having first and second eccentrics mounted thereon, said first eccentric disposed within said first cylinder, said second eccentric disposed within said second cylinder; and a separator plate disposed between said first and second cylinders and having a first piece, a complementary second piece and at least one securement member, each of said first and second pieces including an interior surface, said interior surface defining a semi-circular recess and having at least one securement hole, said at least one securement member having a first end receivable within said at least one securement hole of said first piece and a second end receivable within said at least one securement hole of said second piece whereby said first and second pieces are alignable with one another, said interior surface and said semi-circular recess of said second piece being complementary to said interior surface and said semicircular recess of said first piece, respectively, such that said semi-circular recesses combine to form a circular bore, said circular bore closely capturing a portion of said crankshaft located between said first and second eccentrics.

2. The compressor of claim 1 wherein said first and second cylinders are connected to said separator plate by a plurality of fasteners.

3. The compressor of claim 2 wherein each of said first cylinder, second cylinder, and separator plate includes a set of clearance holes, each of said sets of clearance holes aligned with one another, each of said aligned clearance holes receiving one of said plurality of fasteners.

4. The compressor of claim 3 further comprising a main bearing having a set of threaded holes in alignment with each of said set of clearance holes of said first cylinder, second cylinder, and separator plate, each one of said aligned threaded holes receiving one of said plurality of fasteners, thereby mounting said first cylinder, second cylinder, and two-piece separator onto said main bearing.

5. A twin cylinder rotary compressor comprising:

first and second cylinders;

a crankshaft having first and second eccentrics mounted thereon, said first eccentric disposed within said first cylinder, said second eccentric disposed within said second cylinder; and a separator plate disposed between said first and second cylinders and having a first piece and a complementary second piece, each of said first and second pieces including an interior surface defining a semi-circular recess, said interior surface and said semi-circular recess of said second piece being complementary to said interior surface and said semicircular recess of said first piece, respectively, such that said semi-circular recesses combine to form a circular bore, said circular bore closely capturing a portion of said crankshaft located between said first and second eccentrics;

wherein said separator plate includes a dowel, said dowel having a first end received in a dowel hole in said interior surface of said first piece and a second opposite end received in an opposite dowel hole in said interior surface of said second piece, thereby securely joining said first and second pieces.

6. A twin cylinder rotary compressor comprising:

first and second cylinders;

a crankshaft having first and second eccentrics mounted thereon, said first eccentric disposed within said first cylinder, said second eccentric disposed within said second cylinder; and a separator plate disposed between said first and second cylinders and having a first piece and a complementary second piece, each of said first and second pieces including an interior surface defining a semi-circular recess said interior surface and said semi-circular recess of said second piece being complementary to said interior surface and said semicircular recess of said first piece, respectively, such that said semi-circular recesses combine to form a circular bore, said circular bore closely capturing a portion of said crankshaft located between said first and second eccentrics;

wherein said separator plate includes a threaded fastener, said fastener extending through a clearance aperture in said second piece and engaging a threaded aperture defined in said interior surface of said first piece, thereby securely joining said first and second pieces.

7. The compressor of claim 6 wherein said fastener includes a head portion and said second piece includes an annular surface, said annular surface defining a notch, said clearance aperture defined in said notch and said head portion of said fastener received in said notch.

8. A twin cylinder rotary compressor comprising:

first and second cylinders; and a separator plate disposed between said first and second cylinders and having a first piece, a complementary second piece and at least one securement member, each of said first and second pieces including an interior surface defining a semi-circular recess and at least one securement hole, said at least one securement member having first and second ends receivable within the at least one securement holes of said first and second pieces, respectively, whereby said first and second pieces are alienable with one another, said interior surface and said semi-circular recess of said second piece being complementary to said interior surface and said semicircular recess of said first piece, respectively, such that said semi-circular recesses combine to form a circular bore.

9. The compressor of claim 8 further comprising a crankshaft having first and second eccentrics mounted thereon, said first eccentric disposed within said first cylinder, said second eccentric disposed within said second cylinder; and said circular bore of said separator plate closely captures a portion of said crankshaft located between said first and second eccentrics.

10. A twin cylinder rotary compressor comprising:

first and second cylinders; and a separator plate disposed between said first and second cylinders and having a first piece and a complementary second piece, each of said first and second pieces including an interior surface defining a semi-circular recess, said interior surface and said semi-circular recess of said second piece being complementary to said interior surface and said semicircular recess of said first piece, respectively, such that said semi-circular recesses combine to form a circular bore;

wherein said separator plate includes a dowel, said dowel having a first end received in a dowel hole in said interior surface of said first piece and a second opposite end received in an opposite dowel hole in said interior surface of said second piece, thereby securely joining said first and second pieces.

11. The compressor of claim 10 wherein said first and second cylinders are connected to said separator plate by a plurality of fasteners.

12. The compressor of claim 11 wherein said plurality of fasteners extend through a set of clearance holes in each of said first cylinder, second cylinder and separator plate.

13. The compressor of claim 11 further comprising a main bearing having a set of threaded holes in alignment with each of said set of clearance holes of said first cylinder, second cylinder, and separator plate, said plurality of fasteners engaging said set of threaded holes.

14. A twin cylinder rotary compressor comprising:

first and second cylinders; and a separator plate disposed between said first and second cylinders and having a first piece and a complementary second piece, each of said first and second pieces including an interior surface defining a semi-circular recess, said interior surface and said semi-circular recess of said second piece being complementary to said interior surface and said semicircular recess of said first piece, respectively, such that said semi-circular recesses combine to form a circular bore;

wherein said separator plate includes a threaded fastener, said fastener extending through a clearance aperture in said second piece and engaging a threaded aperture defined in said interior surface of said first piece, thereby securely joining said first and second pieces.

15. The compressor of claim 14 wherein said fastener includes a head portion and said second piece includes an annular surface, said annular surface defining a notch, said clearance aperture defined in said notch and said head portion of said fastener received in said notch.

16. A separator plate for a twin cylinder rotary compressor having first and second cylinders, and a crankshaft extending through the first and second cylinders and having first and second eccentrics mounted thereon comprising:

first and second pieces, said first piece and said second piece disposed between the first and second cylinders, each of said first and second pieces including an interior surface defining a semi-circular recess and at least one securement hole, said interior surface and said semi-circular recess of said second piece being complementary to said interior surface and said semicircular recess of said first piece, respectively; and at least one securement member having a first end and an opposite second end, said first and second ends received within said at least one securement holes of said first and second pieces, respectively, such that said first and second pieces are alignable with one another and said semi-circular recesses combine to form a circular bore, said circular bore adapted to closely encompass a portion of the crankshaft located between the first and second eccentrics.

17. A separator plate for a twin cylinder rotary compressor having first and second cylinders, and a crankshaft extending through the first and second cylinders and having first and second eccentrics mounted thereon comprising:

a first piece and a complementary second piece, said first piece and said second complementary piece disposed between the first and second cylinders, each of said first and second pieces including an interior surface defining a semi-circular recess, said interior surface and said semi-circular recess of said second piece being complementary to said interior surface and said semicircular recess of said first piece, respectively, such that said semi-circular recesses combine to form a circular bore, said circular bore adapted to closely encompass a portion of the crankshaft located between the first and second eccentrics; and a dowel, said dowel having a first end received in a dowel hole in said interior surface of said first piece and a second opposite end received in an opposite dowel hole in said interior surface of said second piece, thereby securely joining said first and second pieces.

18. A separator plate for a twin cylinder rotary compressor having first and second cylinders, and a crankshaft extending through the first and second cylinders and having first and second eccentrics mounted thereon comprising:

a first piece and a complementary second piece, said first piece and said second complementary piece disposed between the first and second cylinders, each of said first and second pieces including an interior surface defining a semi-circular recess, said interior surface and said semi-circular recess of said second piece being complementary to said interior surface and said semicircular recess of said first piece, respectively, such that said semi-circular recesses combine to form a circular bore, said circular bore adapted to closely encompass a portion of the crankshaft located between the first and second eccentrics; and wherein said separator plate includes a threaded fastener, said fastener extending through a clearance aperture in said second piece and engaging a threaded aperture defined in the interior surface of said first piece, thereby securely joining said first and second pieces.

19. The separator plate of claim 18 wherein said fastener includes a head portion and said second piece includes an annular surface, said annular surface defining a notch, said clearance aperture extending from said notch to said interior surface and said head portion of said fastener received in said notch.

20. A method of assembling a twin cylinder rotary compressor comprising the step of:

assembling a compressor sub-assembly by mounting a second cylinder on a main bearing; inserting a crankshaft having first and second eccentrics mounted thereon, into the second cylinder and main bearing; positioning first and second pieces of a separator plate on the second cylinder and around the crankshaft; aligning the first and second pieces of the separator plate together by inserting one end of a securement member into a securement hole in the interior surface of the first piece and inserting an opposite end of the securement member into an opposite securement hole in the interior surface of the second piece such that a semicircular recess in an interior surface of the first piece pairs with a semicircular recess in an interior surface of the second piece to form a bore, and the bore closely encompasses a portion of the crankshaft located between the eccentrics; and mounting a first cylinder about the crankshaft and on the separator plate.

21. The method of claim 20 wherein said step of assembling a compressor sub-assembly further includes securing the first cylinder, the separator plate, and the second cylinder to the main bearing by inserting a fastener into a hole in each of the first cylinder, the separator plate, the second cylinder, and the main bearing.

22. The method of claim 20 further comprising the step of mounting the compressor sub-assembly to a motor by fastening a stator of the motor to the main bearing of the subassembly.

23. The method of claim 22 further comprising the step of mounting the compressor sub-assembly in a housing by heat-expanding the housing, inserting the compressor sub-assembly into the housing and shrink-fitting the housing onto the compressor sub-assembly.

24. A method of assembling a twin cylinder rotary compressor comprising the step of:

assembling a compressor sub-assembly by mounting a second cylinder on a main bearing; inserting a crankshaft having first and second eccentrics mounted thereon, into the second cylinder and main bearing; positioning first and second pieces of a separator plate on the second cylinder and around the crankshaft such that a semicircular recess in an interior surface of the first piece pairs with a semicircular recess in an interior surface of the second piece to form a bore, and the bore closely encompasses a portion of the crankshaft located between the eccentrics; and mounting a first cylinder about the crankshaft and on the separator plate, wherein said step of assembling a compressor sub-assembly further includes fastening the first and second pieces of the separator plate together by inserting one end of a dowel into a dowel hole in the interior surface of the first piece; and inserting an opposite end of the dowel into an opposite dowel hole in the interior surface of the second piece.

25. A method of assembling a twin cylinder rotary compressor comprising the step of:

assembling a compressor sub-assembly by mounting a second cylinder on a main bearing; inserting a crankshaft having first and second eccentrics mounted thereon, into the second cylinder and main bearing; positioning first and second pieces of a separator plate on the second cylinder and around the crankshaft such that a semicircular recess in an interior surface of the first piece pairs with a semicircular recess in an interior surface of the second piece to form a bore, and the bore closely encompasses a portion of the crankshaft located between the eccentrics; and mounting a first cylinder about the crankshaft and on the separator plate, wherein said step of assembling a compressor sub-assembly further includes fastening the first and second pieces of the separator plate together by inserting a threaded fastener through a clearance aperture defined in the second piece and threadedly engaging the fastener to a threaded aperture defined in the interior surface of the first piece.

26. A method of assembling a twin cylinder rotary compressor comprising the steps of:

assembling a compressor sub-assembly by mounting a second cylinder on a main bearing, positioning first and second pieces of a separator plate on the second cylinders aligning the first and second pieces of the separator plate together by inserting one end of a securement member into a securement hole in the interior surface of the first piece and inserting an opposite end of the securement member into an opposite securement hole in the interior surface of the second piece such that a semicircular recess in an interior surface of the first piece pairs with a semicircular recess in an interior surface of the second piece to form a bore; and mounting a first cylinder on the separator plate;

attaching the sub-assembly to a motor to produce a motor-compressor assembly; and mounting the motor-compressor assembly in a housing.

27. The method of claim 26 wherein said step of assembly a compressor sub-assembly further includes inserting a crankshaft having first and second eccentrics mounted thereon, into the second cylinder and main bearing; and positioning first and second pieces of a separator plate on the second cylinder such that the bore closely encompasses a portion of the crankshaft located between the eccentrics.

28. The method of claim 26 wherein said step of attaching the sub-assembly to a motor includes fastening a stator of the motor to the main bearing of the sub-assembly.

29. The method of claim 26 wherein said step of mounting the compressor in a housing includes heat-expanding the housing, inserting the compressor sub-assembly into the housing and shrink-fitting the housing onto the compressor sub-assembly.

* * * * *

UNITED STATES PATENT AND TRADEMARK OFFICE

CERTIFICATE OF CORRECTION

PATENT NO. : 6,799,956 B1
DATED : October 5, 2004
INVENTOR(S) : Zer Kai Yap et al.

It is certified that error appears in the above-identified patent and that said Letters Patent is hereby corrected as shown below:

Column 11,
Line 4, delete “alienable” and insert -- alignable --.

Column 14,
Lines 51-52, delete “cylinders” and insert -- cylinder --.

Signed and Sealed this

Eighteenth Day of January, 2005

JON W. DUDAS
*Director of the United States Patent and Trademark Office*